US005470613A

United States Patent [19]

Rodzewich

[11] Patent Number: 5,470,613

[45] Date of Patent: Nov. 28, 1995

[54] COMPOSITION AND METHOD OF FORMING A BLACK NO-RINSE CONVERSION COATING ON METAL SURFACES

[75] Inventor: Edward A. Rodzewich, Flourtown, Pa.

[73] Assignee: Betz Laboratories, Inc., Trevose, Pa.

[21] Appl. No.: 186,962

[22] Filed: Jan. 27, 1994

Related U.S. Application Data

[63] Continuation-in-part of Ser. No. 32,079, Mar. 17, 1993, abandoned, which is a continuation-in-part of Ser. No. 823,216, Jan. 21, 1992, abandoned.

[51] Int. Cl.[6] ..... B05D 3/10

[52] U.S. Cl. ..... 427/388.1; 427/388.5; 148/244; 106/14.33; 106/14.39

[58] Field of Search ..... 427/388.5, 388.1; 106/14.33, 14.39; 148/244

[56] References Cited

U.S. PATENT DOCUMENTS

| | | | |
|---|---|---|---|
| 3,849,141 | 11/1974 | Palm et al. | 106/1 |
| 3,960,610 | 6/1976 | Steinbrecher et al. | 427/409 |
| 3,990,920 | 11/1976 | DeRidder et al. | 106/14 |
| 4,103,049 | 7/1978 | Nishido et al. | 427/388 C |
| 4,130,431 | 12/1978 | Kogure | 106/1.12 |
| 4,636,264 | 1/1987 | Schellenberg et al. | 148/6.2 |
| 4,719,038 | 1/1988 | Sobata et al. | 106/14.39 |
| 4,755,434 | 7/1988 | Fujii et al. | 427/409 |
| 4,755,435 | 7/1988 | Fujii et al. | 427/202 |
| 4,799,959 | 1/1989 | Fourez et al. | 106/14.21 |
| 4,931,317 | 6/1990 | Shima et al. | 427/385.5 |

*Primary Examiner*—Anthony McFarlane
*Attorney, Agent, or Firm*—Alexander D. Ricci; Steven D. Boyd

[57] ABSTRACT

A black, no-rinse conversion coating on metal surfaces is provided. The treatment of a metal such as aluminum or aluminum alloys with a composition of hexavalent chromium, an acrylic/itaconic modified styrene butyl acrylate polymer resin, a fluoacid, and carbon black results in a black no-rinse conversion coating.

4 Claims, No Drawings

COMPOSITION AND METHOD OF FORMING A BLACK NO-RINSE CONVERSION COATING ON METAL SURFACES

This application is a continuation-in-part of application Ser. No. 08/032,079 filed Mar. 17, 1993, now abandoned, which is a continuation-in-part of application Ser. No. 07/823,216 filed Jan. 21, 1992, now abandoned.

FIELD OF THE INVENTION

The present invention relates to a method and composition for the formation of a black conversion coating on metal surfaces. More particularly, the present invention relates to a method and composition for the formation of a black no-rinse conversion coating on metals such as aluminum and its alloys. The process has been found to be particularly effective at forming a corrosion resistant black coating on aluminum surfaces in a single step no-rinse operation.

BACKGROUND OF THE INVENTION

Methods for the formation of black films or coatings on the surfaces of various metal are currently available. The methods vary with the particular type of metal, e.g., ferrous metals, stainless steels, zinc and its alloys, aluminum and its alloys, copper and its alloys. The composition of the treatment solution and the treatment conditions vary from case to case.

Japanese Patent Publication No. 56-33155 (33155/81)in the name of Nihon Parkerising Company, Ltd. discloses a method of forming a black coating with an aqueous resin containing solution followed by baking to produce a coating of the desired weight. The aqueous solution contains a hexavalent chromium compound, a reducing agent and water soluble resin.

In the treating of many aluminum or aluminum alloy articles the more common procedure is to first apply a conversion coating such as a chromium based coating and thereafter to apply a solvent based black paint. The first step creates a corrosion resistant conversion coating. The second painting step is almost exclusively a decorative and aesthetic step. Such two step processes require extra equipment and waste disposal procedures. Coatings such as described in Japanese Patent Publication Number 56-33155 also require ovens to bake the coated metal to form the coating thereon. Similarly, U.S. Pat. No. 4,931,317 discloses a method and composition for the formation of a black film or coating on the surface of various materials by coating and subsequent baking of a treatment solution containing ferrous metal ions, hexavalent chromium, trivalent chromium and a film forming polymer dissolved or dispersed in water. The black nature of the coating is due to the concentration of hexavalent chromium and metal salts (Co, Fe and Ni) in the solution.

SUMMARY OF THE INVENTION

It has been found that a single step, black, no-rinse conversion coating can be formed on aluminum and aluminum alloys by the composition and methods of the present invention. The composition and methods of the present invention are directed to a chromium based conversion coating in conjunction an acrylic/itaconic modified styrene butyl acrylate polymer emulsion, a fluoacid, and a carbon black pigment. It was discovered that a coating solution comprising hexavalent chromium in conjunction with a modified styrene acrylic resin/latex emulsion, a fluoacid, and a black pigment would form a single step, no rinse, black, conversion coating on aluminum and aluminum alloys. The black coating does not require any baking operation. However, forced drying as in an oven may be used to decrease processing time. The black coating can be applied by spraying, immersion, draw bar, flow coating or roll coating. The resulting black coating is an adhering, flexible, corrosion resistant film.

DESCRIPTION OF THE PREFERRED EMBODIMENT

It has been found that a black, conversion coating can be formed on aluminum and its alloys in a single no-rinse step. The black coating of the present invention is formed by applying a coating solution to a clean aluminum or aluminum alloy surface. The coating solution may be applied in any conventional manner such as spray, immersion, or roll coating. The coating solution is allowed to dry in place after application forming a black, conversion coating thereon.

The coating solution of the present invention comprises from about 0.01 to 0.20% an aqueous solution of hexavalent chromium in conjunction with from about 2.0 to 10% (as solids) an acrylic/itaconic modified styrene butyl acrylate polymer emulsion, from about 0.2 to 1.0% a fluoacid, and from about 0.5 to 3% a carbon black pigment. The pH of the coating solution should be below 7 and is preferably between 2 and 3. It is believed that the corrosion resistant conversion coating is formed during the drying step. The chromium is present initially as hexavalent chromium in the coating solution. As the applied wet coating solution dries, the hexavalent chromium reacts with the aluminum surface where it is reduced to trivalent chromium. This reaction leads to the formation of the conversion coating. It is also believed that the trivalent chromium destabilizes the resin present in the coating solution causing the deposition of an insoluble film on the metal surface. The presence of carbon black in the resin emulsion results in a black conversion coating being formed. The fluoacid, in the form of hydrofluoric acid, fluozirconic acid or fluosilicic acid, increases the coating reactivity and efficacy.

It was found that the pigment, preferably carbon black, is more easily dispersed in a resin emulsion than in a resin solution. Also, such resin emulsions have been found to exhibit better film forming characteristics. Such action is preferable when treating complex shapes. It was found that the preferred color and stability in the coating composition was provided by a non-ionic dispersion of carbon black. The preferred resin of the present invention is an acrylic/itaconic modified styrene acrylic butyl acrylate polymer emulsion.

The coating composition of the present invention may include thickeners such as gums and other swelling polymers to modify the solution viscosity. Such thickeners are employed to assist in applying the solution to the metal articles being treated. The use of thickeners allows a black dried in place conversion coating to be formed from solutions having a reduced solids content.

For economic reasons it may be desirable, in certain situations, to reduce the level of latex emulsion in the coating solution. As the latex level is reduced, drainage time decreases and the resultant film becomes thinner. This thinning of the film results in a streaking, brown-black appearance. In addition, emulsion polymers do not possess an intrinsic ability to wet pigments. Consequently as the solids level is lowered, a poor wetting situation can develop as evidenced by carbon black destabilization in the dried coating. This can be controlled by the addition of a suitable surfactant or dispersant which serves to stabilize the carbon black in the emulsion polymer.

The selection of a suitable carbon black dispersion is based in part on the conditions of operation and the desired end results. Commercial aqueous carbon black dispersions are available which differ in degree of jetness, pigment level, type of dispersing agent (anionic/cationic), pH and conductivity. It was found that anionic dispersed carbon blacks were unstable in latex emulsion systems at pH below 7.0 which contain cations such as chromic acid and aluminum. Accordingly, in a hexavalent chromic acid treatment for aluminum, non-ionic carbon black dispersions are preferred.

In situations where economics make a low solids coating bath desirable, wetting and dispersing agents are employed to solubilize the coalescents and for forming a continuous coating. Anionic surfactants and dispersants tend to destabilize a carbon black-emulsion mixture which results in a diphase separation in the coating bath and a particulate build-up in both the bath and the coating itself. Non-ionic surfactants were found to be best suited for use in the preferred chromic acid based coating bath for aluminum of the present invention.

Coalescents may be added to the coating bath to improve the flow of the bath over the pad being coated and also to improve film uniformity. Fast and slow evaporating type coalescents were tested and slow evaporating coalescents such as Texanol® (a 2,2,4 trimethyl pentane 1,3 diol monoisobutyrate available from Eastman Chemical Products, Inc., of Kingspod, Tenn. ) were found to provide the best film in the preferred coating bath of the present invention. Coalescents can be classed based upon their volatility compared to butyl acetate. With butyl acetate having a volatility of 100, fast coalescents have volatilities of greater than about 5 while slow coalescents have volatility of less than about 3. For example, the preferred coalescent of the present invention, Texanol, has a volatility of 0.2.

In a low solids formulation, thickening agents compatible with the coating bath must be selected. Acrylic based thickeners function only in alkaline conditions. Hydroxy cellulose will thicken a low solids acid formulation but were found to produce poor wetting and film formation. Polyacrylamides were found to cause flocculation of a carbon black coating system. Polysaccharide, xanthan gums and guar gums were found to be compatible and effective in chromic acid/carbon black coating systems. Rhodopal 23 (a tradename for a xanthan gum available from R. T. Vanderbilt of Norwalk, Conn.) was found to be an effective thickener in acid, black no-rinse systems. In addition, a synergy was discovered between Rhodopal and Veegum® magnesium aluminum silicate (a mineral dispersant available from R. T. Vanderbilt Corp. of Norwalk, Conn.) which resulted in a high viscosity at low concentration in acid conditions. However, at low solids concentration the strong flocculation characteristics of Veegum can result in carbon destabilization and cracking in the dried film. Therefore, Rhodopol alone is the preferred thickener.

For economies in shipping and handling, the coating composition of the present invention is preferably supplied commercially as a concentrated solution. It was found that the increased concentration of thickening agents in a concentrated coating solution could adversely affect the stability of the carbon black dispersion. For this reason, the coating composition of the present invention, when supplied as a concentrate, is preferably supplied in two parts. The first part being a concentrate of chromic acid coating solution absent thickening agents and the seconds part, thickening agents, carbon black, etc., which can be mixed and combined with the first part prior to use.

The present invention will now be further illustrated by the following examples which are intended solely for the purpose of illustration and are not to be regarded as limiting the scope of the invention or the manner in which it is practiced.

Testing was undertaken to develop a low solids black no-rinse. At low solids conditions problems of poor wetting, poor surface coverage, etc., are more prevalent. In addition, other problems such as marginal bath stability and poor film forming become more apparent. Thus, at low solids conditions surfactants or dispersants, coalescents, and thickening agents become desirable.

A variety of potential low solids, black no-rinse formulations were prepared and tested in acetic acid and neutral salt spray testing. Table 1 summarized the formulations evaluated and Table 2 the Corrosion Test results.

TABLE 1

BLACK NO-RINSE FORMULATIONS

| | A | B | C | D | E | F | G | H | I | J | K |
|---|---|---|---|---|---|---|---|---|---|---|---|
| DI WATER | 89.72 | 91.52 | 89.72 | 89.72 | 89.72 | 89.72 | 89.72 | 89.72 | 89.72 | 89.42 | 89.42 |
| RHOPLEX 23 | 0.18 | 0.18 | 0.18 | 0.18 | 0.18 | 0.18 | 0.18 | 0.18 | 0.18 | 0.18 | 0.18 |
| SYNTHEMUL 40-422 | 6.00 | 6.00 | 6.00 | — | — | — | — | 6.00 | — | 6.00 | — |
| SYNTHEMUL 40-430 | — | — | — | — | — | — | — | — | — | — | — |
| RHOPLEX WL-91 | — | — | — | 6.00 | — | — | — | — | 6.00 | — | 6.00 |
| RHOPLEX AC-73 | — | — | — | — | — | 6.00 | — | — | — | — | — |
| RHOPLEX 1803 | — | — | — | — | — | — | 6.00 | — | — | — | — |
| AROLON 845-W-45 | — | — | — | — | 6.00 | — | — | — | — | — | — |
| AQUABLAK 115 | 0.80 | — | 0.80 | 0.80 | 0.80 | 0.80 | 0.80 | 0.80 | 0.80 | 0.80 | 0.80 |
| AQUABLAK 235A | 1.00 | — | 1.00 | 1.00 | 1.00 | 1.00 | 1.00 | 1.00 | 1.00 | 1.00 | 1.00 |
| TRITON CF54 | 0.20 | 0.20 | 0.20 | 0.20 | 0.20 | 0.20 | 0.20 | — | — | — | — |
| SURFONIC N95 | 0.10 | 0.10 | 0.10 | 0.10 | 0.10 | 0.10 | 0.10 | 0.10 | 0.10 | 0.10 | 0.10 |
| SURFYNOL TG | — | — | — | — | — | — | — | 0.20 | 0.20 | 0.20 | 0.20 |
| M-PYROL | 1.00 | 1.00 | 1.00 | 1.00 | 1.00 | 1.00 | 1.00 | 1.00 | 1.00 | 1.00 | 1.00 |
| RESIMENE 745 | 0.30 | 0.30 | — | 0.30 | 0.30 | 0.30 | 0.30 | 0.30 | 0.30 | 0.30 | 0.30 |
| RESIMENE AQ7550 | — | — | — | — | — | — | — | — | — | — | — |
| UCAR RD-652 | — | — | 0.30 | — | — | — | — | — | — | 0.30 | 0.30 |
| HYDROSIL 2627 | — | — | — | — | — | — | — | — | — | — | — |
| FLUOZIRCONIC ACID (40.8%) | 0.70 | 0.70 | 0.70 | 0.70 | 0.70 | 0.70 | 0.70 | 0.70 | 0.70 | 0.70 | 0.70 |
| TOLUENE SULFONIC ACID | — | — | — | — | — | — | — | — | — | — | — |

TABLE 1-continued

BLACK NO-RINSE FORMULATIONS

| | | | | | | | | | | | |
|---|---|---|---|---|---|---|---|---|---|---|---|
| AMMON. DICHROMATE SOLUTION 1 ML = 0.25 GRAMS | — | — | — | — | — | — | — | — | — | — | — |
| CHROMIC ACID | 0.10 | 0.10 | 0.10 | 0.10 | 0.10 | 0.10 | 0.10 | 0.10 | 0.10 | 0.10 | 0.10 |
| APPEARANCE OF BATH AFTER 4 DAYS STORAGE | LTG | SG | SG | LTG | LTG | LTG | LTG | SG | TG | SG | TG |

| | L | M | N | O | P | Q | R | S | T | U |
|---|---|---|---|---|---|---|---|---|---|---|
| DI WATER | 90.72 | 89.72 | 89.72 | 89.72 | 89.72 | 90.72 | 89.62 | 90.42 | 90.22 | 90.72 |
| RHOPLEX 23 | 0.18 | 0.18 | 0.18 | 0.18 | 0.18 | 0.18 | 0.18 | 0.18 | 0.18 | 0.18 |
| SYNTHEMUL 40-422 | — | 6.00 | 6.00 | 6.00 | 6.00 | 6.00 | 6.00 | 6.00 | 6.00 | — |
| SYNTHEMUL 40-430 | — | — | — | — | — | — | — | — | — | 6.00 |
| RHOPLEX WL-91 | 6.00 | — | — | — | — | — | — | — | — | — |
| RHOPLEX AC-73 | — | — | — | — | — | — | — | — | — | — |
| RHOPLEX 1803 | — | — | — | — | — | — | — | — | — | — |
| AROLON 845-W-45 | — | — | — | — | — | — | — | — | — | — |
| AQUABLAK 115 | 0.80 | 0.80 | 0.80 | 0.80 | 0.80 | 0.80 | 0.80 | 0.80 | 0.80 | 0.80 |
| AQUABLAK 235A | 1.00 | 1.00 | 1.00 | 1.00 | 1.00 | 1.00 | 1.00 | 1.00 | 1.00 | 1.00 |
| TRITON CF54 | 0.20 | 0.20 | 0.20 | 0.20 | 0.20 | 0.20 | 0.20 | 0.20 | 0.20 | 0.20 |
| SURFONIC N95 | 0.10 | 0.10 | 0.10 | 0.10 | 0.10 | 0.10 | 0.10 | 0.10 | 0.10 | 0.10 |
| SURFYNOL TG | — | — | — | — | — | — | — | — | — | — |
| M-PYROL | 1.00 | 1.00 | 1.00 | 1.00 | 1.00 | 1.00 | 1.00 | 1.00 | 1.00 | 1.00 |
| RESIMENE 745 | — | — | — | 0.30 | 0.30 | — | 0.30 | 0.30 | 0.30 | — |
| RESIMENE AQ7550 | — | 0.30 | 0.30 | — | — | — | — | — | — | — |
| UCAR RD-652 | — | — | — | — | — | — | — | — | — | — |
| HYDROSIL 2627 | — | — | — | — | — | — | 0.10 | — | — | — |
| FLUOZIRCONIC ACID (40.8%) | — | 0.70 | 0.70 | 0.70 | 0.70 | — | 0.70 | — | — | — |
| TOLUENE SULFONIC ACID | — | — | — | — | — | — | — | — | 0.20 | — |
| AMMON. DICHROMATE SOLUTION 1 ML = 0.25 GRAMS | — | — | — | 2 ml | 4 ml | 4 ml | — | 4 ml | 4 ml | 4 ml |
| CHROMIC ACID | 0.10 | 0.10 | — | 0.10 | 0.10 | 0.10 | 0.10 | 0.10 | 0.10 | 0.10 |
| APPEARANCE OF BATH AFTER 4 DAYS STORAGE | NG | LSG | SG | LTG | LTG | NG | TG | SG | TG | NG |

KEY:
NG—NO GEL
TG—HARD GEL
L—LIQUID SURROUNDING GEL

Synthemul® 40-430 is a styrene-acrylic copolymer synthetic resin emulsion available from Reichhold Chemicals, Inc., of Dover, Del. Rhoplex AC73 is a polyacrylic emulsion available from Rohm & Haas of Philadelphia, Pa. Rhoplex 1803 is a hydroxy functional acrylic emulsion available from Rohm & Haas. Triton CF54 is a modified polyethoxy adduct available from Rohm & Haas of Philadelphia, Pa. Surfonic N95 is an ethoxylated nonyl phenol available from Jefferson Chemical Company of Bellaire, Tex. M-Pyrol is a N-methyl-2-pyrolidone available from BASF of Parsippany, N.J. Synthemul 40-422 is a high molecular weight emulsion of acrylic and styrene monomers available from Reichhold Chemicals, Inc., Dover, Del. Arolon 845-W-45 is a vinyl acrylic emulsion from Reichhold Chemicals, Inc., Dover, Del. Rhoplex WL-91 is a thermoplastic acrylic dispersion from Rohm & Haas of Philadelphia, Pa. Aquablak 115 is a non-ionic carbon black dispersion from Borden, Inc., of Columbus, Ohio. Aquablack 235A is a non-ionic, low surfactant carbon black dispersion from Borden, Inc., of Columbus, Ohio. Surfynol TG is a non-ionic surfactant from Air Products and Chemicals of Allentown, Pa. Resimene 745 is a methylated melamine-formaldehyde resin from Monsanto Chemical Co., St. Louis, Mo. Resimene AQ 7550 is an aqueous methylated melamine-formaldehyde resin from Monsanto Chemical Co., St. Louis, Mo. Ucar RD 65-2 is a Hydroxylethyl Ethylene Urea Solution, available from Union Carbide Corp., Danbury, Conn. Hydrosil 2627 is a modified amino silane polymer from Huls America, Inc., Piscataway, N.J.

TABLE 2

CORROSION RESULTS

| | Acetic Acid Spray Hours | | | | Neutral Salt Spray Hours | | Pencil | Film Build |
|---|---|---|---|---|---|---|---|---|
| Formula | 168 | 260 | 336 | 1000 | 1000 | 2000 | Hardness | (Mils) |
| A (212) | 10 | 9 | 8 | 6 | 10 | 10 | F | 0.18–0.22 |
| A (250) | 10 | 9 | 8 | 7 | 10 | 10 | H | 0.18–0.22 |
| A (300) | 10 | 9 | 8 | 6 | 10 | 10 | H | 0.18–0.22 |
| A (350) | 10 | 9 | 8 | 4 | 10 | 10 | H | 0.18–0.22 |
| B (212) | 10 | 10 | 9 | 5 | 10 | 10 | H | 0.15–0.20 |
| B (250) | 10 | 10 | 9 | 5 | 10 | 10 | H | 0.15–0.20 |
| B (300) | 10 | 10 | 9 | 4 | 10 | 10 | H | 0.15–0.20 |
| B (350) | 10 | 10 | 9 | 4 | 10 | 10 | 2H | 0.15–0.20 |

TABLE 2-continued

| | CORROSION RESULTS | | | | | | | |
|---|---|---|---|---|---|---|---|---|
| | Acetic Acid Spray Hours | | | | Neutral Salt Spray Hours | | Pencil | Film Build |
| Formula | 168 | 260 | 336 | 1000 | 1000 | 2000 | Hardness | (Mils) |
| C (212) | 10 | 10 | 9 | 7 | 10 | 10 | HB | 0.18–0.22 |
| C (250) | 10 | 10 | 9 | 6 | 10 | 10 | HB | 0.18–0.22 |
| D (212) | 4 | — | — | — | 10 | 10 | F | 0.18–0.22 |
| D (250) | 4 | — | — | — | 10 | 10 | H | 0.18–0.22 |
| D (300) | 4 | — | — | — | 10 | 10 | H | 0.18–0.22 |
| D (350) | 8 | 8 | 8 | 5 | 10 | 10 | H | 0.18–0.22 |
| E (212) | 10 | 10 | 9 | 6 | 10 | 10 | 2H | 0.18–0.22 |
| E (250) | 10 | 10 | 9 | 8 | 10 | 10 | 2H | 0.18–0.22 |
| F (212) | 10 | 9 | 9 | 5 | 10 | 10 | HB | 0.18–0.22 |
| F (250) | 4 | — | — | — | 10 | 10 | F | 0.18–0.22 |
| G (212) | 10 | 9 | 8 | 6 | 10 | 10 | H | 0.18–0.22 |
| G (250) | 10 | 9 | 8 | 7 | 10 | 10 | 2H | 0.18–0.22 |
| H (212) | 10 | 10 | 8 | 6 | 10 | 10 | H | 0.18–0.22 |
| H (250) | 10 | 10 | 8 | 6 | 10 | 10 | H | 0.18–0.22 |
| I (212) | 8 | 8 | 0 | — | 10 | 10 | H | 0.18–0.22 |
| I (250) | 8 | 0 | — | — | 10 | 10 | H | 0.18–0.22 |
| J (212) | 4 | — | — | — | 10 | 10 | H | 0.18–0.22 |
| J (250) | 10 | 10 | 8 | 4 | 10 | 10 | H | 0.18–0.22 |
| K (212) | 3 | — | — | — | 10 | 10 | B | 0.18–0.22 |
| K (250) | 4 | — | — | — | 10 | 10 | B | 0.18–0.22 |
| L (212) | 3 | — | — | — | 10 | 10 | 2H | 0.12–0.15 |
| L (250) | 3 | — | — | — | 10 | 10 | 2H | 0.12–0.15 |
| M (212) | 4 | — | — | — | 10 | 10 | HB | 0.15–0.20 |
| M (250) | 10 | 9 | 7 | 5 | 10 | 10 | F | 0.15–0.20 |
| N (212) | 2 | — | — | — | 0 at 168 hours | | 3H | 0.15–0.20 |
| N (250) | 2 | — | — | — | 0 at 168 hours | | H | 0.15–0.20 |
| O (250) | 10 | 10 | 8 | 6 | 10 | 10 | H | 0.12–0.18 |
| P (250) | 10 | 10 | 10 | 8 | 10 | 10 | 2H | 0.12–0.18 |
| Q (250) | 10 | 7 | 5 | 5 | 10 | 10 | H | 0.12–0.15 |
| R (212) | 10 | 8 | 7 | 6 | 10 | 10 | HB | 0.15–0.20 |
| R (250) | 10 | 8 | 7 | 6 | 10 | 10 | F | 0.15–0.20 |
| S (212) | 10 | 8 | 6 | 5 | 10 | 10 | 2H | 0.12–0.15 |
| S (250) | 10 | 8 | 6 | 5 | 10 | 10 | 2H | 0.12–0.15 |
| T (212) | 10 | 7 | 5 | 5 | 10 | 10 | 2H | 0.12–0.15 |
| U (212) | 10 | 10 | 10 | 7 | 10 | 10 | H | 0.12–0.15 |
| U (250) | 10 | 8 | 5 | 4 | 10 | 10 | F | 0.12–0.15 |

Note:
Acetic acid spray results are consistent with ASTM D610-43.

From Tables 1 and 2 it can be seen that Neutral salt spray results were excellent for all of the formulations screened except N which did not include chromic acid. Acetic acid salt spray were acceptable at 260 hours. Hexavalent chromium levels of 0.1% as chromic acid produce the best results. Bake temperatures did not appear to influence film performance.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of forming a black conversion coating on surfaces of aluminum and its alloys comprising:

coating the surface with a coating solution having a pH below 7 consisting essentially of a. from about 0.01 to about 0.20% hexavalent chromium;

b. from about 2.0 to about 10% acrylic/itaconic modified styrene butyl acrylate polymer resin (as solid);

c. from about 0.5 to about 3.0% carbon black pigment;

d. from about 0.2 to about 1.0% fluoacid;

e. a thickening agent selected from the group consisting of guar gum and xanthan gum and drying said coating on said surface without rinsing; and optionally f. a non-ionic dispersant and/or a slow evaporating coalescent.

2. The method of claim 1 wherein said fluoacid is selected from the group hydrofluoric acid, fluozirconic acid and fluosilicic acid.

3. A fluid composition of matter, consisting essentially of:

a. from about 0.01 to about 0.20% hexavalent chromium;

b. from about 2 to about 10% acrylic/itaconic modified styrene butyl acrylate polymer resin (as solid);

c. from about 0.5 to about 3.0% carbon black pigment;

d. from about 2.2 to about 1.0% fluoacid;

e. a thickening agent selected from the group consisting of guar gum and xanthan gum; and optionally f. a non-ionic dispersant and/or a slow evaporating coalescent.

4. The composition of claim 3 wherein said fluoacid is selected from the group hydrofluoric acid, fluozirconic acid, and fluosilicic acid.

* * * * *